United States Patent [19]

Schwengeler

[11] 4,415,125

[45] Nov. 15, 1983

[54] APPARATUS FOR WINDING A THREAD

[75] Inventor: Peter Schwengeler, Winterthur, Switzerland

[73] Assignee: Rieter Machine Works Limited, Winterthur, Switzerland

[21] Appl. No.: 365,512

[22] Filed: Apr. 5, 1982

[30] Foreign Application Priority Data

Apr. 24, 1981 [CH] Switzerland ..... 2691/81

[51] Int. Cl.[3] ..... B65H 54/46

[52] U.S. Cl. ..... 242/18 DD

[58] Field of Search ..... 242/18 DD

[56] References Cited

U.S. PATENT DOCUMENTS

| | | | |
|---|---|---|---|
| 492,613 | 2/1893 | Pierce | 242/18 DD |
| 1,277,933 | 9/1918 | Holt et al. | 242/18 DD |
| 4,089,480 | 5/1978 | Kamp | 242/18 DD |
| 4,138,071 | 2/1979 | Schewe | 242/18 DD |

FOREIGN PATENT DOCUMENTS

| | | | |
|---|---|---|---|
| 1912374 | 5/1970 | Fed. Rep. of Germany | 242/18 DD |
| 21652 | of 1910 | United Kingdom | 242/18 DD |
| 21653 | of 1910 | United Kingdom | 242/18 DD |

*Primary Examiner*—Stanley N. Gilreath
*Attorney, Agent, or Firm*—Werner W. Kleeman

[57] ABSTRACT

An apparatus for winding a thread or the like upon a rotatable, conical bobbin tube by means of a rotatable friction drive drum containing a plurality of rotational elements adjacently arranged upon a common drive or driving shaft and contacting the bobbin package along a generatrix. A first one of the rotational elements is rigidly rotatably connected with the drive shaft and at least two further rotational elements are freely rotatably mounted upon a respective rotational or rotary bearing mounted at the drive shaft. In one specific embodiment a respective one of these two further elements is provided at each end of the first element and such further elements are intercoupled by a differential gear arrangement. Due to the differing surface speeds of the bobbin package and the friction drive drum abrasion or scuffing occurs at the site of mutual contact of the bobbin package and the friction drive drum, such abrasion damaging the wound thread material. This abrasion is reduced to a considerable degree with the invention. Also there is afforded a reliable drive of the bobbin package, such that owing to the resultant constancy of the mean thread tension, it is sufficient to provide a non-controlled driven and therefore simpler thread storage. In the special constructural embodiment the size of the prevailing friction surface of the friction drive drum is equal to that of a non-subdivided friction drive drum, but the abrasion action is practically avoided.

5 Claims, 5 Drawing Figures

APPARATUS FOR WINDING A THREAD

BACKGROUND OF THE INVENTION

The present invention relates to a new and improved construction of apparatus for winding filamentary material, such as specifically a thread or yarn—hereinafter simply usually referred to as a thread—upon a rotatable conical bobbin tube so as to form a bobbin package.

Genrally speaking, the winding apparatus of the present development contains a rotatable friction drive drum for winding the thread onto the rotatable conical bobbin tube into the bobbin package. This friction drive drum comprises a plurality of substantially cylindrical rotational elements which are arranged upon a common driving or drive shaft and which contact the bobbin tube or the bobbin package, respectively, along a generatrix. With this arrangement, during the winding operation, the bobbin package and the friction drive drum roll upon one another.

For winding a thread or yarn into a bobbin package the use of conical bobbin tubes, i.e. substantially truncated cone-shaped tubes, is desirable in many instances. The rotation of the bobbin tubes which is required for producing the bobbin package, as a general rule, is generated through the use of a substantially cylindrical friction drive drum. This friction drive drum contacts the bobbin tube or the thread material which has already been wound upon the bobbin tube, as the case may be, along a generatrix. With this arrangement, the bobbin tube or the bobbin package, as the case may be, is frictionally entrained by the friction drive drum. Since the bobbin tube is of conical shape and the friction drive drum is of cylindrical shape, it will be appreciated that the surface speeds of these rotating bodies along the previously mentioned generatrix or contact line do not coincide with one another. Specifically, at the locations or points of relatively large diameter of the bobbin tube the jacket or outer surface of the bobbin tube moves at a greater circumferential speed, and at the points or locations of relatively small diameter of the bobbin tube the jacket or outer surface of the bobbin tube moves at a slower circumferential speed, than the surface of the friction drive drum. Thus, the surfaces which are in mutual contact with one another at such locations tend to rub or abrade against one another, something which is quite undesirable because there is impaired during such scuffing action the quality of the wound-up thread.

In German Patent Publication No. 2,228,488 there is disclosed an apparatus wherein, for the purpose of maintaining the winding speed and the uniformity of the thread tension at a distribution drum, there is maintained small the contact surface of the distribution drum at the bobbin package. In this way there can be considerably reduced the abrasion or scuffing of the surface of the bobbin package and the distribution drum. However, when using a small contacting surface the frictional engagement or coupling between the bobbin package and the cylindrical distribution drum, and therefore, also the entrainment of the bobbin package, has proven to be insufficient.

In Russian Pat. No. 494,868 there has been disclosed the use of a drive drum composed of a plurality of elements for winding a bobbin package which is driven by a shaft rotating at a constant speed. Two elements of the drive drum can be selectively connected, as desired, by a coupling with the shaft in order to transmit the drive, so as to control the winding speed and to obtain a uniform density of the windings of the wound bobbin package. Yet, this Russian patent is not concerned at all with the presence of surfaces which slide and abrade against one another.

SUMMARY OF THE INVENTION

Therefore, with the foregoing in mind it is a primary object of the present invention to provide a new and improved construction of apparatus for winding a thread in a manner not afflicted with the aforementioned drawbacks and limitations.

A further and more specific object of the present invention aims at providing a new and improved construction of winding apparatus for a thread or the like which reduces the aforementioned abrasion action to a large degree, while ensuring for a reliable drive of the bobbin tube and the bobbin package, respectively.

Yet a further significant object of the present invention aims at the provision of a new and improved construction of a winding apparatus for a thread which allows for the provision of a simple thread storage device without a controlled drive, because of the constancy of the mean thread tension of the thread which is to be wound and resulting from the constant thread supply speed.

A further significant object of the present invention is directed to a new and improved construction of winding apparatus for filamentary materials, typically threads, yarns or the like, which winding apparatus is relatively simple in construction and design, extremely economical to manufacture, highly reliable in operation, not readily subject to breakdown or malfunction, requires a minimum of maintenance and servicing, and produces a wound thread package of improved thread quality.

Now in order to implement these and still further objects of the invention, which will become more readily apparent as the description proceeds, the winding apparatus of the present development is manifested by the features that a first element of the friction drive drum is connected with the shaft for conjoint rotation therewith, and at least two further elements of the firction drive drum are freely rotatably mounted upon a respective rotational or rotary bearing mounted at the shaft.

According to a special construction of the invention utilizing three elements, at each end of the first element which is rigidly connected with the shaft there is provided a respective further element. These further elements are operatively coupled with one another by a differential gear or gearing arrangement. This construction of the invention affords the additional advantage that the three elements drivingly augment one another, which is comparable to a particularly large frictional surface for the drive. In other words, the friction surface is the same in size as if the friction drive drum were not subdivided, however, the abrasion or scuffing action is practically precluded. Additionally, with this embodiment there can be dispensed with the use of a suseptible or sensitive friction covering or coating formed of rubber, even under those conditions where normally such friction covering or coating is used.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
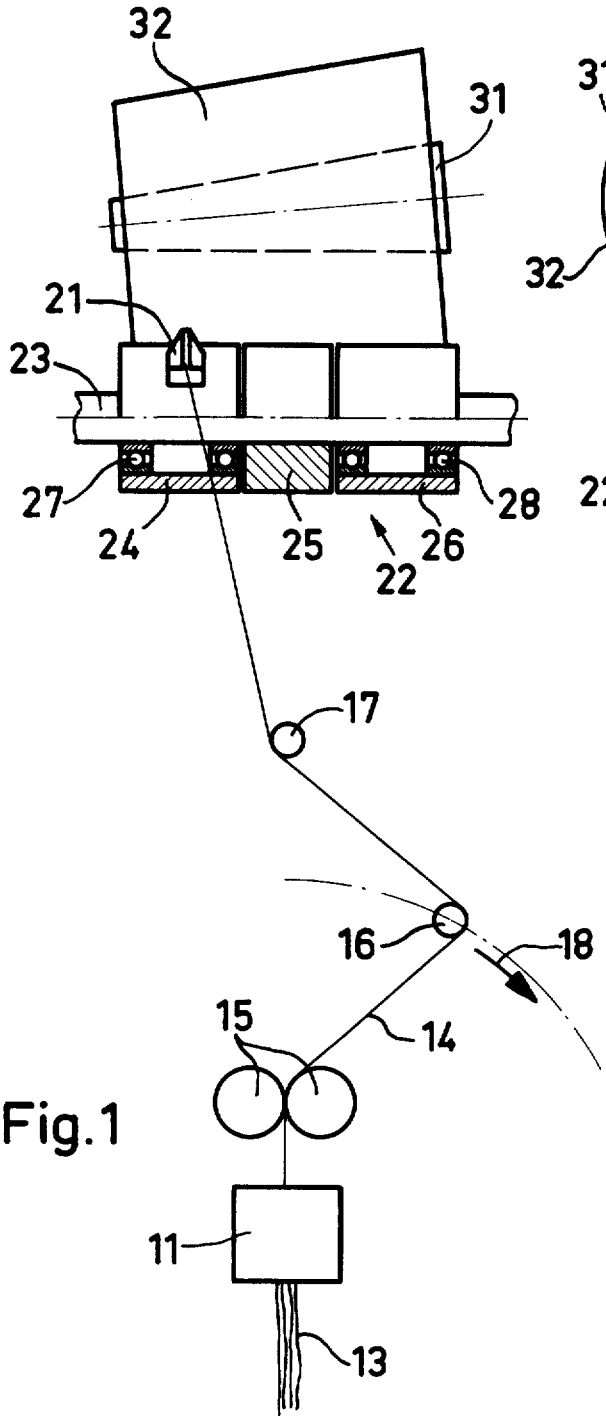
FIG. 1 is a longitudinal sectional view of a winding apparatus constructed according to the invention and schematically depicting its incorporation into a spinning process.

Describing now the drawings, it is to be understood that only enough of the construction of the winding apparatus and the related spinning station has been shown as will enable those skilled in this art to readily understand the underlying principles and concepts of the present development, while simplifying the showing of the drawings. Turning attention specifically to FIG. 1, there will be recognized a conventional spinning unit 11 where a fiber sliver 13 or the like is spun into a yarn or thread 14 which, as will be recalled, usually has simply been generically referred to as a thread. Feed or transport rolls 15 serve to upwardly move the thread 14. This thread 14 passes through two thread guides or eyelets 16 and 17 or equivalent structure constituting an arrangement for compensating for variable thread lengths. For this purpose, the thread guide or eyelet 16 is pre-tensioned or biased by using, for example a spring or a weight, in the direction of the arrow 18 and is movable to-and-fro along the path indicated by the dash-dotted line.

The thread 14 passes from the thread guide 17 to a thread guide 21 located in front of a rotatable friction drive drum 22. This friction drive drum 22 comprises an externally driven shaft 23 upon which there are mounted three rotational elements 24, 25 and 26. The elements 24 and 26 are supported so as to be freely rotatable upon related bearings 27 and 28, respectively. On the other hand, the intermediate element 25 is rigidly connected with the rotatable shaft 23. Above the friction drive drum 22 there is located a conical or frustoconical bobbin tube 31 which, when the thread 14 is wound thereon, forms a bobbin package 32, as best seen by also referring to FIG. 2. During the thread winding process the thread guide 21 moves to-and-fro essentially parallel to the shaft 23 across the length of the bobbin package 32, as is well known in the textile winding art.

During operation of the winding apparatus according to the embodiment disclosed with reference to FIG. 1, the shaft 23 and along therewith the element 25 rigidly mounted thereon, are placed into rotation. This intermediate element 25, by virtue of the prevailing friction, entrains the bobbin package 32 or, as the case may be, the bobbin tube 31 at the beginning of the winding process, which is pressed against such element 25, in a manner such that the bobbin package 32 or the bobbin tube 31, respectively, also is placed into rotation. The rotating bobbin package 32, in turn, because of the prevailing friction, entrains the rotational elements 24 and 26 and places these into rotation. By virtue of the rotation of the friction drive drum 22 and the bobbin package 32 it will be recognized that the thread 14 is wound into a thread package. The to-and-fro movement of the thread guide 21 effects an even distribution of the thread which is to be wound or spooled.

The bobbin package 32 and the substantially cylindrically configured friction drive drum 22 are in mutual contact with one another along a generatrix. Under the assumption that the friction drive drum 22 consists of a single cylindrically-shaped body forming a unit, all of the points on the surface of such friction drive drum would move circumferentially at the same surface speed. At the bobbin package 32 all points of its jacket-shaped surface have the same angular velocity, however the surface velocity or speed, that is, the distances covered per unit of time by the points of its surface at the location of the smallest bobbin package diameter (in FIG. 1 appearing at the left-hand side) are smallest and at the location of the largest bobbin package diameter (in FIG. 1 at the right-hand side) are largest.

During the winding process, the surface speeds of the heretofore known friction drive drum of the conventional type assumed previously above and at the outset of this disclosure and consisting of only one single body and the bobbin package are only equal at the vicinity of their centers or control regions, with respect to the axial direction of the friction drive drum and the bobbin package. Thus, at the generatrix, along which the friction drive drum and the bobbin package are in mutual contact, there occurs a mutual sliding and abrasion which is that much larger the closer the place considered is to the lateral ends of the friction drive drum and the bobbin package and the longer the construction of the friction drive drum and the bobbin package. This mutual abrasion or scuffing causes damage to the wound-up fiber material, particularly the fiber material wound at the outermost zones of the bobbin package 32. Now, however, in accordance with the teachings of the present invention such is beneficially prevented, or at the least appreciably minimized, in that the friction drive drum 22, according to the invention, is subdivided into three elements 24, 25 and 26. In the drawing the distances between the rotational elements 24, 25 and 26 have been shown exaggerated for purposes of clarity in the illustration. If there are used the three friction drive drum elements 24, 25 and 26, instead of a single, but however three times as long friction drive drum, there are especially eliminated the sites or zones of great abrasive movements. The abrasive movements which still remain after subdividing the friction drive drum 22 are within limits within which the thread or yarn can still yield in a manner such that damage is avoided. Care is to be taken however that there is ensured for a reliable and secure entrainment of the bobbin tube 31 and the bobbin package 32, respectively, at all times. It is for this reason that the rotational element 25 is not chosen to be too short. According to an advantageous construction the three rotational elements 24, 25 and 26 are approximately of the same length.

Figure 3:
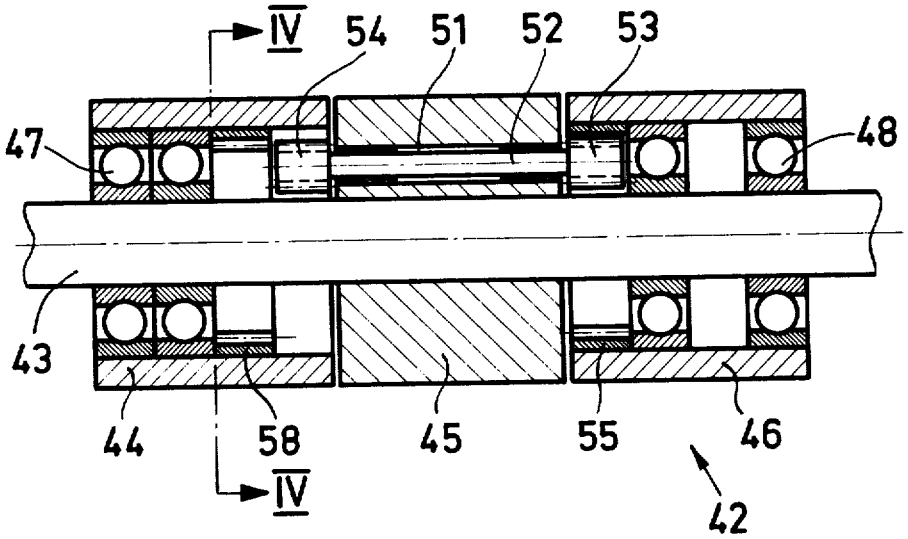
FIG. 3 is a fragmentary longitudinal sectional view of a further embodiment of a drivable shaft of a winding apparatus according to the invention, the sectional view being taken substantially along the line III—III of FIG. 4.
Figure 4:
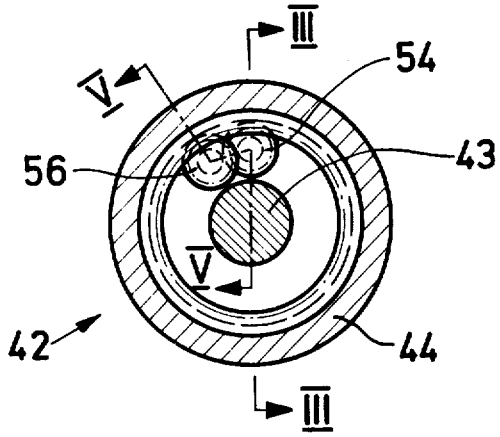
FIG. 4 is a cross-sectional view of the arrangement depicted in FIG. 3, taken substantially along the line IV—IV thereof.
Figure 5:
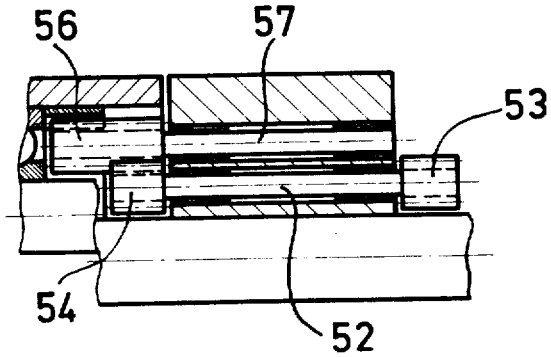
FIG. 5 is a sectional view of the arrangement of FIG. 4, taken substantially along the line V—V thereof, and serving for further explaining the second embodiment depicted in FIGS. 3 and 4.

Continuing, FIGS. 3, 4 and 5 depict a further embodiment of a friction drive drum 42 constructed according to the invention. This friction drive drum 42 here also contains a shaft 43 upon which there are juxtapositionally or adjacently arranged the rotational elements 44, 45 and 46. Here also the elements 44 and 46 are rotatably supported upon bearings 47 and 48, respectively, and the intermediate element 45 is rigidly connected for rotation with the shaft 43.

The rotational element 45 contains two adjacently situated bores extending parallel to the rotatable shaft 43, only one of the bores 51 being visible in the showing of FIG. 3. In this one bore 51 there is rotatably supported a transmission shaft 52. This transmission shaft 52 is provided at its one end with a gear 53 and at its other end with a further gear 54. The rotational or rotatable element 46 is in the form of a hollow cylinder and is internally provided at its inner surface with a toothed rim or ring tooth arrangement 55 which meshes with the gear teeth of the gear 53. A further gear 56 is mounted on one end of a support shaft 57 which is rotatably supported in the second bore 51, as best seen by referring to FIG. 5. This second bore 51 is arranged behind the bore 51 visible in the showing of FIG. 3, as also will be apparent from the illustration of FIG. 5, although such second bore 51 is not visible in either FIGS. 3 and 4. In the illustration of FIG. 5, depicting a top view of the arrangement, there have only been illustrated the transmission shaft 52, the support shaft 57 and the gears 53, 54 and 56. The gear 56, in axial direction, is about twice as long as the gear 54. These gears 54 and 56 mesh with one another. Furthermore, the gear 56 meshes with a toothed rim or ring tooth arrangement 58 which is provided at the inner wall or surface of the hollow cilindrically-shaped rotational element 44. The gear arrangement shown in FIG. 5, together with the toothed rims or ring tooth arrangements 55 and 58, forms a differential gear arrangement or differential gearing.

Figure 2:
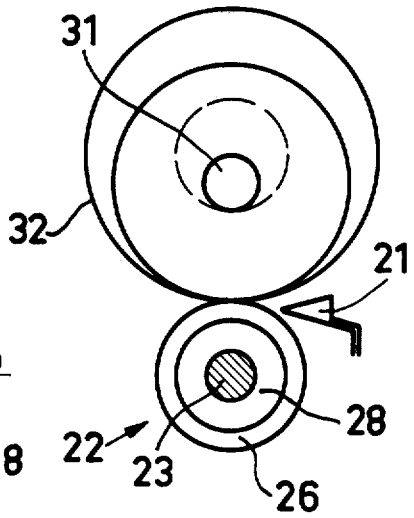
FIG. 2 is an end view of the arrangement shown in FIG. 1, looking from the left-hand side thereof.

If again, as has been previously specifically shown in conjunction with FIGS. 1 and 2, there is imagined a bobbin package which contacts the friction drive drum 42 along a generatrix, then this bobbin package will be placed into rotation by the rotational element 45 during rotation of the rotatable shaft 43. Consequently, because of the action of the rotating bobbin package the elements 44 and 46 will be placed into rotation. In a position of the bobbin package, as shown in FIG. 1 for the bobbin package 32, the element 46 rotates at a higher surface speed or velocity than the element 44. With the same length of the elements 44 and 46 this means that the surface speed of the element 46 is higher by the same amount, and the corresponding speed of the element 44 is lower by the same amount, than the corresponding speed of the element 45. Such rotatational state also prevails if the differential gearing or differential gear arrangement, with the parts 52 to 58, during one revolution of the element 46 in one direction effects one revolution of the element 44 in the opposite direction, i.e if the gearing ratio is 1:1.

If no bobbin package, such as the bobbin package 32 shown in FIG. 1, contacts the friction drive drum 42 shown in FIG. 3, and if the rotatable shaft 43 is driven, then the rotational element 45 is entrained, and there are rotated the shafts 52 and 57 along with the gears 53, 54 and 56. Since the gear 53 meshes with the toothed rim or ring tooth arrangement 55 and the gear 54 meshes, by means of the gear 56, with the toothed rim or ring tooth arrangement 58, the rotational elements 44 and 46 are entrained by the gears 53, 54 and 56 and the friction drive drum 42 rotates as a unit about the rotational axis of the shaft 43. On the other hand, if a bobbin package bears in a position as shown in FIG. 1 against the friction drive drum 42, then, as previously described, there in initiated a rotation of the rotational element 46 in one rotational sense and a rotation of the rotational element 44 in the opposite rotational sense by the same amounts. With this arrangement it has been assumed that the distance of the centers of the elements 46 and 44 from the center of the element 45 are of the same magnitude. Under these circumstances the rotational movements coincide with the ones effected by the differential gear arrangement with a gearing ratio of 1:1. The rotational movement exerted by the bobbin package upon the rotational element 44 therefore is transmitted, by means of the differential gearing or differential gear arrangement, to the rotational element 46, and conversely, a rotational moment or torque of the rotational element 46 is exerted upon the rotational element 44. Thus, with the dimensions being selected as above-described, these elements always move at a speed which is exactly adapted to the bobbin package.

Consequently, the uniformity of the speed of thread winding is increased, and the length compensation obtained by means of the thread guides or eyelets 16, 17 possesses smaller fluctuations.

As a rule, a group of three rotational elements will be used in which, generally, as shown in the exemplary embodiments, the intermediate or central element is driven by the related drive shaft and the outer elements are driven by the bobbin package. However, design modifications are possible in which there can be provided to each side of the intermediate element two freely rotatable elements. On the other hand, the outer elements can be chosen so as to possess different lengths, wherein in the case of the embodiment of FIGS. 3, 4 and 5 there must be employed an appropriately accommodated transmission ratio of the differential gearing. It is also possible to have a construction wherein the elements mounted at the rotational or rotary bearings are both located at the same end of the rotational element which is fixedly rotatably connected with the shaft. This last-mentioned element, in all cases, must be chosen to have a length sufficient to ensure that there is possible a slip-free drive of the bobbin package. If the elements are all of the same length there is realized the advantage that, there are minimized the zones where there occurs a sliding or abrading of the outer portions.

While there are shown and described present preferred embodiments of the invention, it is to be distinctly understood that the invention is not limited thereto, but may be otherwise variously embodied and practiced within the scope of the following claims. Accordingly,

What I claim is:

1. An apparatus for winding a thread upon a rotatable, substantially conical bobbin tube into a bobbin package, comprising:

a rotatable friction drive drum;

said rotatable friction drive drum comprising a plurality of substantially cylindrical rotational elements;

a common driving shaft upon which there are mounted said rotational elements;

said rotatable friction drive drum contacting the bobbin tube and when thread is wound upon the bobbin tube the wound bobbin package along a generatrix;

said bobbin package and the friction drive drum rolling upon one another during the thread winding operation;

said plurality of cylindrical rotational elements comprising three of said rotational elements constituting a first element rigidly connected for rotation with said shaft and at least two further rotational elements;

one of said rotational elements constituting an intermediate element;

the remaining two rotational elements each being respectively arranged at an opposite end of the intermediate element;

a respective rotational bearing provided for each of said at least two remaining rotational elements of the friction drive drum and at each of which rotational bearings there is mounted a related one of said two remaining rotational elements so as to be supported to be freely rotatable upon said shaft; and differential gearing means for mutually coupling said two remaining rotational elements with one another.

2. The winding apparatus as defined in claim 1, wherein:

said differential gearing means comprises a transmission shaft rotatably supported at said intermediate element and extending substantially parallel to said common driving shaft;

said transmission shaft having opposed ends;

one of the ends of said transmission shaft being operatively coupled with one of the two remaining elements for generating a rotational movement in a predetermined rotational sense; and the other opposed end of said transmission shaft being coupled to the other one of said remaining elements for generating a rotational movement in an opposite rotational sense.

3. The winding apparatus as defined in claim 2, wherein:

said transmission shaft is provided at one of its ends with a first gear;

a toothed rim extending over an inner surface of a hollow cylindrical zone of said one of said two remaining elements;

said first gear meshing with said toothed rim;

said transmission shaft being provided at said other opposed end with a second gear;

a third gear meshing with said second gear;

said third gear extending substantially parallel to said second gear; and a toothed rim extending over an inner surface of a hollow substantially cylindrical zone of said other one of said remaining elements; and said third gear meshing with said toothed rim of said other one of said remaining elements.

4. The winding apparatus as defined in claim 1, wherein:

each of said three rotational elements are approximately of the same length.

5. The winding apparatus as defined in claim 1, wherein:

an outer surface of at least said first element constitutes a relatively high friction surface in relation to the bobbin package.

* * * * *